US012188170B2

(12) United States Patent
Borgerson et al.

(10) Patent No.: US 12,188,170 B2
(45) Date of Patent: Jan. 7, 2025

(54) UNDER-CABINET SEAL TO PREVENT EXHAUST RECIRCULATION FOR A CONDENSING APPLIANCE

(71) Applicant: WHIRLPOOL CORPORATION, Benton Harbor, MI (US)

(72) Inventors: Matthew E. Borgerson, St. Joseph, MI (US); Justin Nguyen, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/401,858

(22) Filed: Jan. 2, 2024

(65) Prior Publication Data

US 2024/0133113 A1 Apr. 25, 2024

Related U.S. Application Data

(63) Continuation of application No. 17/101,441, filed on Nov. 23, 2020, now Pat. No. 11,891,749.

(51) Int. Cl.
*D06F 58/24* (2006.01)
*D06F 58/04* (2006.01)

(52) U.S. Cl.
CPC ..... *D06F 58/24* (2013.01); *D06F 58/04* (2013.01)

(58) Field of Classification Search
CPC ..... D06F 58/24; D06F 58/94
USPC ..... 34/138, 595–610
See application file for complete search history.

(56) References Cited

U.S. PATENT DOCUMENTS 2,785,557 A * 3/1957 Stilwell, Jr. ..... D06F 37/266 68/19.2
3,027,653 A * 4/1962 Long ..... D06F 58/20 34/605
3,559,728 A 2/1971 Lyman et al.
4,459,177 A 7/1984 O'Hare
5,117,563 A * 6/1992 Castonguay ..... D06F 58/20 34/604
6,944,969 B2 * 9/2005 Clodic ..... F26B 23/004 34/604
7,921,578 B2 * 4/2011 McAllister ..... D06F 35/00 34/597
8,627,581 B2 * 1/2014 Brown ..... D06F 58/20 34/607
8,844,163 B2 9/2014 Palazzin et al.
(Continued)

FOREIGN PATENT DOCUMENTS

CN 114525665 A 5/2022
EP 2423376 A1 2/2012
(Continued)

*Primary Examiner* — Stephen M Gravini
(74) *Attorney, Agent, or Firm* — Price Heneveld LLP

(57) ABSTRACT

A drying appliance includes a cabinet with a processing chamber operably disposed therein. A blower delivers process air through an airflow path. The airflow path includes the processing chamber. A condensing airflow path has an inlet positioned within a front panel of the cabinet and an outlet positioned within a bottom panel of the cabinet. A condensing blower moves condensing air from the inlet to the outlet. An airflow seal extends downward from a front edge of the cabinet. The airflow seal separates a low-pressure region proximate the inlet from a high-pressure region proximate the outlet to block convection between the outlet and the inlet.

20 Claims, 7 Drawing Sheets

(56) References Cited

U.S. PATENT DOCUMENTS

| | | | | |
|---|---|---|---|---|
| 9,200,838 | B2 * | 12/2015 | Kwon | D06F 25/00 |
| 9,249,538 | B2 | 2/2016 | Bison et al. | |
| 9,976,249 | B2 | 5/2018 | Lv et al. | |
| 10,820,782 | B2 | 11/2020 | Hofmann et al. | |
| 11,686,041 | B2 | 6/2023 | Del Maschio et al. | |
| 11,697,901 | B2 | 7/2023 | Masters | |
| 11,891,749 | B2 * | 2/2024 | Borgerson | D06F 58/20 |
| 2003/0079368 | A1 * | 5/2003 | Hoffman | F26B 5/045 34/201 |
| 2012/0049705 | A1 | 3/2012 | Palazzin et al. | |
| 2022/0162794 | A1 | 5/2022 | Borgerson et al. | |
| 2023/0228030 | A1 | 7/2023 | Patil | |
| 2023/0265601 | A1 | 8/2023 | Cha et al. | |
| 2023/0287621 | A1 | 9/2023 | Yoon et al. | |
| 2024/0133113 | A1 * | 4/2024 | Borgerson | D06F 58/20 |

FOREIGN PATENT DOCUMENTS

| | | | | | |
|---|---|---|---|---|---|
| EP | 2669424 | A1 | | 12/2013 | |
| EP | 2719817 | A1 | | 4/2014 | |
| EP | 2573252 | B1 | | 5/2014 | |
| EP | 2752518 | A1 | | 7/2014 | |
| EP | 4001498 | A1 | * | 5/2022 | D06F 58/02 |
| KR | 20100129242 | A | * | 12/2010 | |
| WO | WO-2010137910 | A2 | * | 12/2010 | D06F 25/00 |

* cited by examiner

UNDER-CABINET SEAL TO PREVENT EXHAUST RECIRCULATION FOR A CONDENSING APPLIANCE

CROSS-REFERENCE TO RELATED APPLICATION

The present application is a continuation of U.S. patent application Ser. No. 17/101,441 filed Nov. 23, 2020, now U.S. Pat. No. 11,891,749, entitled UNDER-CABINET SEAL TO PREVENT EXHAUST RECIRCULATION FOR A CONDENSING APPLIANCE, the entire disclosure of which is hereby incorporated herein by reference.

BACKGROUND OF THE DISCLOSURE

The present disclosure generally relates to laundry appliances, and more specifically, a seal that is positioned beneath the appliance cabinet for blocking airflow from an exhaust duct from recirculating back into an inlet for a condensate system of the appliance.

SUMMARY OF THE DISCLOSURE

According to one aspect of the present disclosure, a drying appliance includes a cabinet with a processing chamber operably disposed therein. A blower delivers process air through an airflow path. The airflow path includes the processing chamber. A condensing airflow path has an inlet positioned within a front panel of the cabinet and an outlet positioned within a bottom panel of the cabinet. A condensing blower moves condensing air from the inlet to the outlet. An airflow seal extends downward from a front edge of the cabinet. The airflow seal separates a low-pressure region proximate the inlet from a high-pressure region proximate the outlet to block convection between the outlet and the inlet.

According to another aspect of the present disclosure, a condensing dryer includes a cabinet with a processing chamber operably disposed therein. A recirculating airflow path is disposed within the cabinet and extends through the processing chamber and a dehumidification area. A condensing airflow path directs condensing air from an inlet disposed within a front panel of the cabinet, through the dehumidification area and to an outlet disposed within a bottom panel of the cabinet. An airflow seal extends downward from a front edge of the cabinet and to a position below supporting feet of the cabinet. The airflow seal defines a convection barrier that separates a high-pressure region proximate the outlet from a low-pressure region proximate the inlet.

According to yet another aspect of the present disclosure, an airflow system for a laundry appliance includes an outer cabinet having a recirculating airflow path contained therein. A condensing airflow path is in thermal communication with the recirculating airflow path and extends from an inlet proximate a front panel of the outer cabinet to an outlet proximate a bottom panel of the outer cabinet. The inlet defines a low-pressure region within an area in front of the front panel of the outer cabinet and the outlet defines a high-pressure region within an area beneath the outer cabinet. A convection barrier is attached to the cabinet along a lower front edge. The convection barrier blocks convection between the low-pressure region and the high-pressure region.

These and other features, advantages, and objects of the present disclosure will be further understood and appreciated by those skilled in the art by reference to the following specification, claims, and appended drawings.

Figure 1:
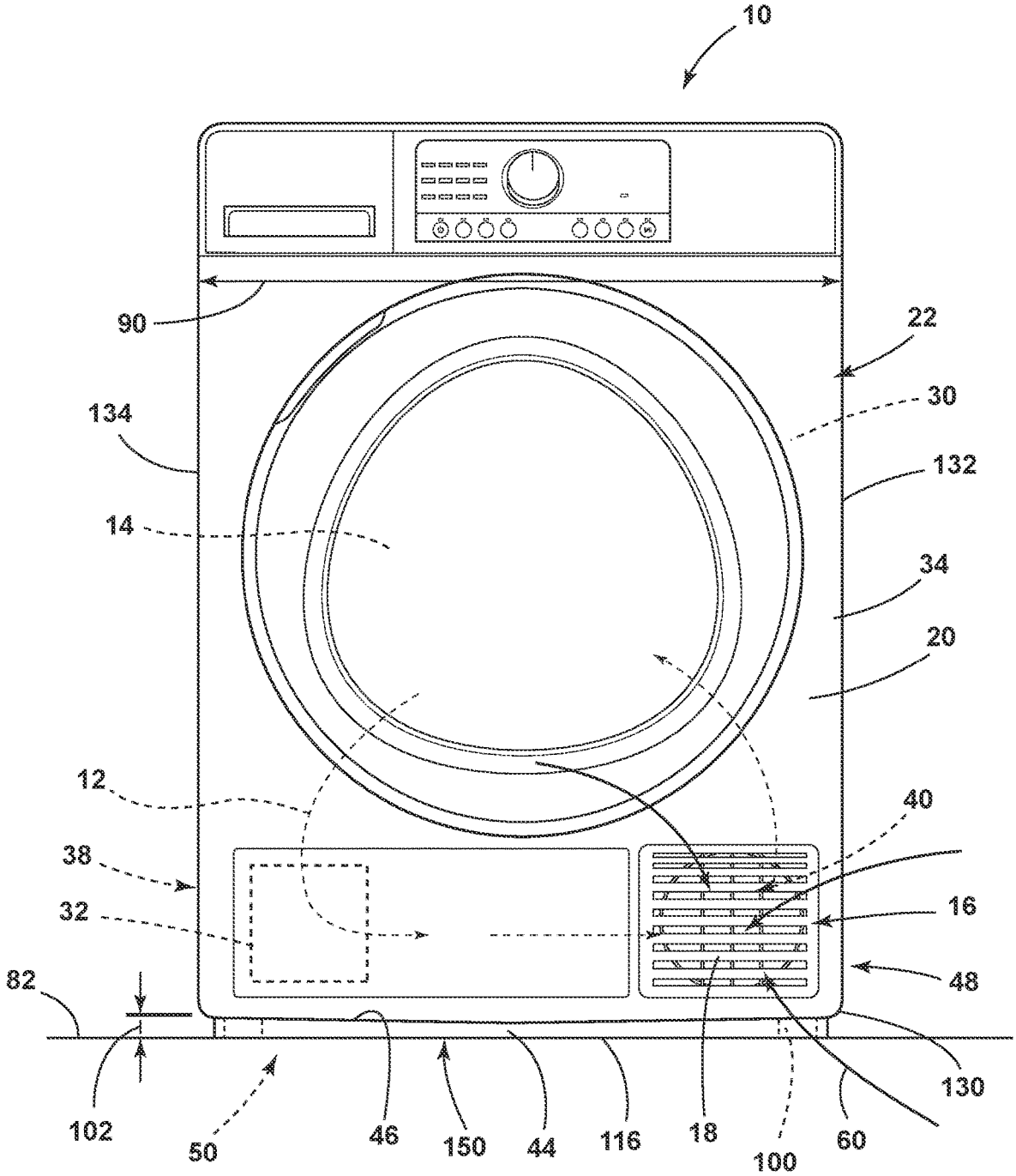
FIG. 1 is a front elevational view of a laundry appliance incorporating an aspect of the airflow seal.

The components in the figures are not necessarily to scale, emphasis instead being placed upon illustrating the principles described herein.

DETAILED DESCRIPTION

The present illustrated embodiments reside primarily in combinations of method steps and apparatus components related to a convection-blocking seal that prevents direct recirculation of exhaust air into a condensing airflow path. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally refers to an appliance, typically a condensing laundry appliance that includes an internal primary airflow path 12 that delivers process air to a drum 14 for dehumidifying articles of clothing within the drum 14. The condensing laundry appliance 10 also includes a condensing airflow path 16 that extends from an inlet 18 positioned on an exterior 20 of a cabinet 22 for the appliance 10 to an outlet 24 positioned within a separate section of the cabinet 22. Accordingly, the condensing appliance 10 includes an open-loop condensing airflow path 16 that extends through the heat exchanger (not shown) within the appliance 10.

According to various aspects of the device, the appliance 10 includes a cabinet 22 with a processing chamber operably disposed therein. The processing chamber is typically in the form of a rotating drum 14 that is positioned within a tub 30. A blower 32 delivers process air through the primary airflow path 12. The primary airflow path 12 includes the processing chamber and a heat exchange mechanism. The condensing airflow path 16 includes the inlet 18 that is positioned within a front panel 34 of the cabinet 22. An outlet 24 of the condensing airflow path 16 is positioned within a bottom panel 36 of the cabinet 22, commonly referred to as the basement 38. A condensing blower 40 is included within the appliance 10 and moves condensing air 42 from the inlet 18, through the heat exchange mechanism and to the outlet 24. An airflow seal 44 extends downward from a front edge 46 of the cabinet 22. The airflow seal 44 separates a low-pressure region 48 that is positioned proximate the inlet 18 from a high-pressure region 50 that is located proximate the outlet 24. The airflow seal 44 operates to block convection between the outlet 24 and the inlet 18. This convection is typically in the form of air within the high-pressure region 50 tending to move toward the low-pressure region 48 proximate the front of the appliance 10. Stated another way, the airflow seal 44 is positioned to block airflow from short cutting directly from the outlet 24 to the inlet 18.

The condensing appliance 10 includes the open-loop condensing airflow path 16 that draws fresh ambient air 60 from around the cabinet 22 into the inlet 18 and moves this ambient air 60 through the heat exchange mechanism and then through the outlet 24. The primary airflow path 12 for the delivery of process air is heated and delivered to the processing chamber for removing moisture from the articles to be dried. The heated and moisture-laden air from the processing chamber is then delivered to the heat exchange mechanism. Within the heat exchange mechanism, ambient air 60 within the condensing airflow path 16 operates as condensing air 42 that lowers the temperature of the process air. In this manner, the process air lowers in temperature and is at least partially dehumidified and cooled. This process air is then recycled through a heater and back into the drum 14 to continue the dehumidification process of the articles within the drum 14. The condensing air 42 receives heat 74 from the process air and is moved to the outlet 24.

In order to maximize operation of the heat exchange mechanism, ambient air 60 drawn into the inlet 18 typically has a temperature generally similar to that of the surrounding atmosphere of the appliance 10. Conversely, exhaust air 70 leaving the outlet 24 of the condensing airflow path 16 typically has an elevated temperature as a result of receiving heat 74 from the heated and moisture-laden process air within the heat exchange mechanism. The airflow seal 44 positioned along a front edge 46 of the cabinet 22 provides a convection barrier 150 that prevents the heated exhaust air 70 from the outlet 24 for returning directly to the inlet 18 for the condensing airflow path 16 (shown in dashed line in FIG. 2). In this manner, the airflow seal 44 causes the exhaust air 70 to follow a circuitous route 72 along the outside of the laundry appliance 10 before being able to re-enter the condensing airflow path 16 through the inlet 18. Through this circuitous route 72, heat 74 within the exhaust air 70 is able to dissipate within the air surrounding the cabinet 22. Accordingly, any exhaust air 70 that may re-enter the inlet 18 has had an opportunity to cool to a temperature at or near the ambient atmosphere.

Using the airflow seal 44, ambient air 60 entering the inlet 18 for the condensing airflow path 16 has a temperature that is at or very similar to the environment surrounding the cabinet 22 for the appliance 10. This configuration serves to maintain efficiency of the condensing airflow path 16 and the heat exchange mechanism within the appliance 10. Typically, the heat exchange mechanism in a condensing dryer is an air-to-air heat exchanger. Within this air-to-air heat exchanger, process air passes within close proximity of the condensing air 42 and the difference in temperature of the process air and the condensing air 42 generates a thermal transfer that cools the process air, and at the same time, increases the temperature of the condensing air 42 within the heat exchange mechanism.

Referring again to FIGS. 1-7, the airflow seal 44 that is attached to the cabinet 22 along the front edge 46 extends from the underside 80 of the cabinet 22 and to the floor surface 82 that supports the cabinet 22. Accordingly, the airflow seal 44 can define a continuous barrier along the front edge 46 that does not allow air to pass under the airflow seal 44. The exhaust air 70 leaving the outlet 24 for the condensing airflow path 16 must travel around the airflow seal 44 in order to have an opportunity to return to the inlet 18. Again, this elongated or circuitous route 72 of the exhaust air 70 allows time for the heat 74 within the exhaust air 70 to dissipate within the surrounding environment. Typically, the airflow seal 44 extends along an entirety of the front edge 46 of the front panel 34 for the cabinet 22. In certain aspects of the device, the airflow seal 44 can extend along a majority of the front edge 46 of the front panel 34. In either instance, the airflow seal 44 extends substantially the entire width 90, or the entire width 90, of the appliance 10 and extends to the floor surface 82 to create the convection barrier 150.

Figure 3:
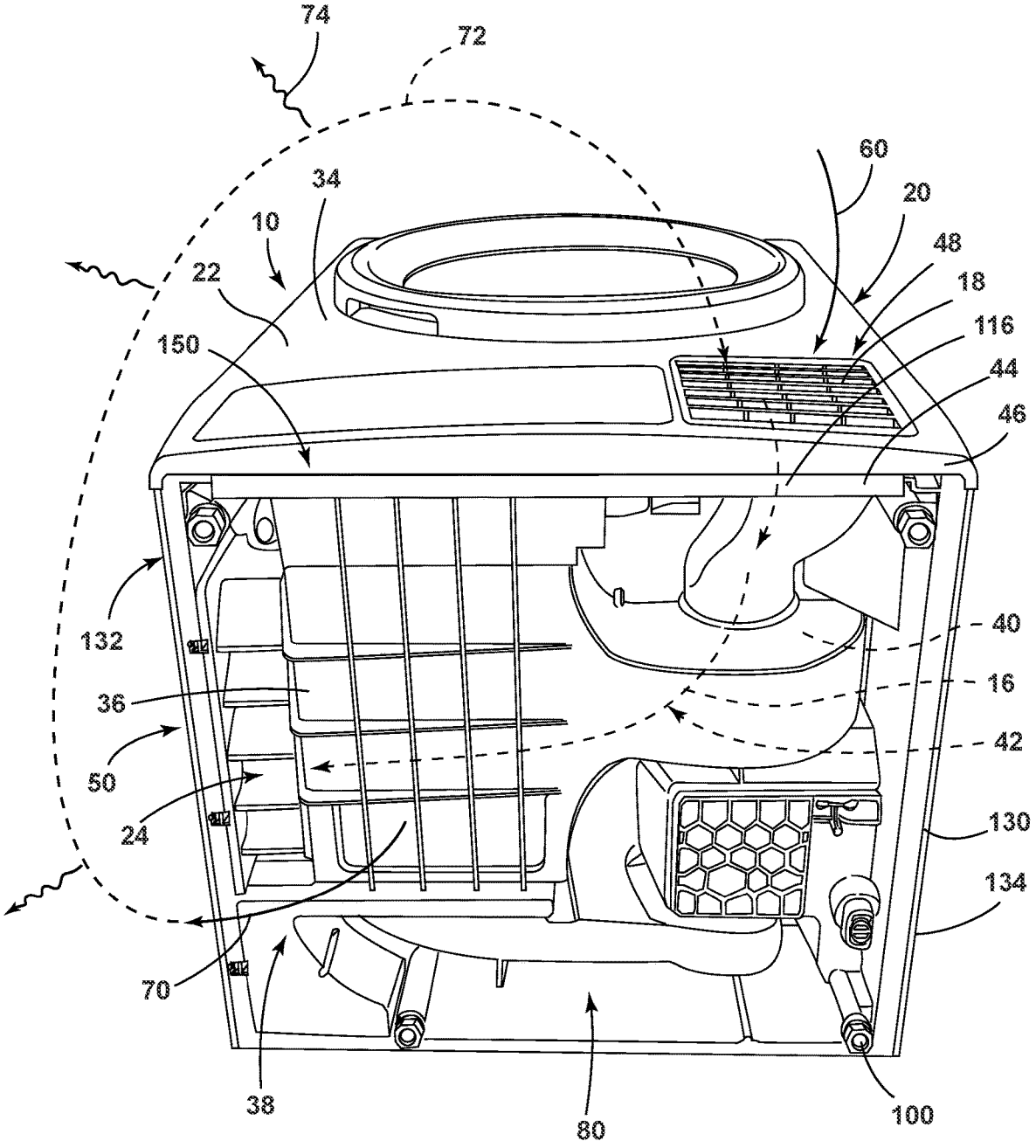
FIG. 3 is a bottom perspective view of a laundry appliance incorporating an aspect of the airflow seal.
Figure 5:
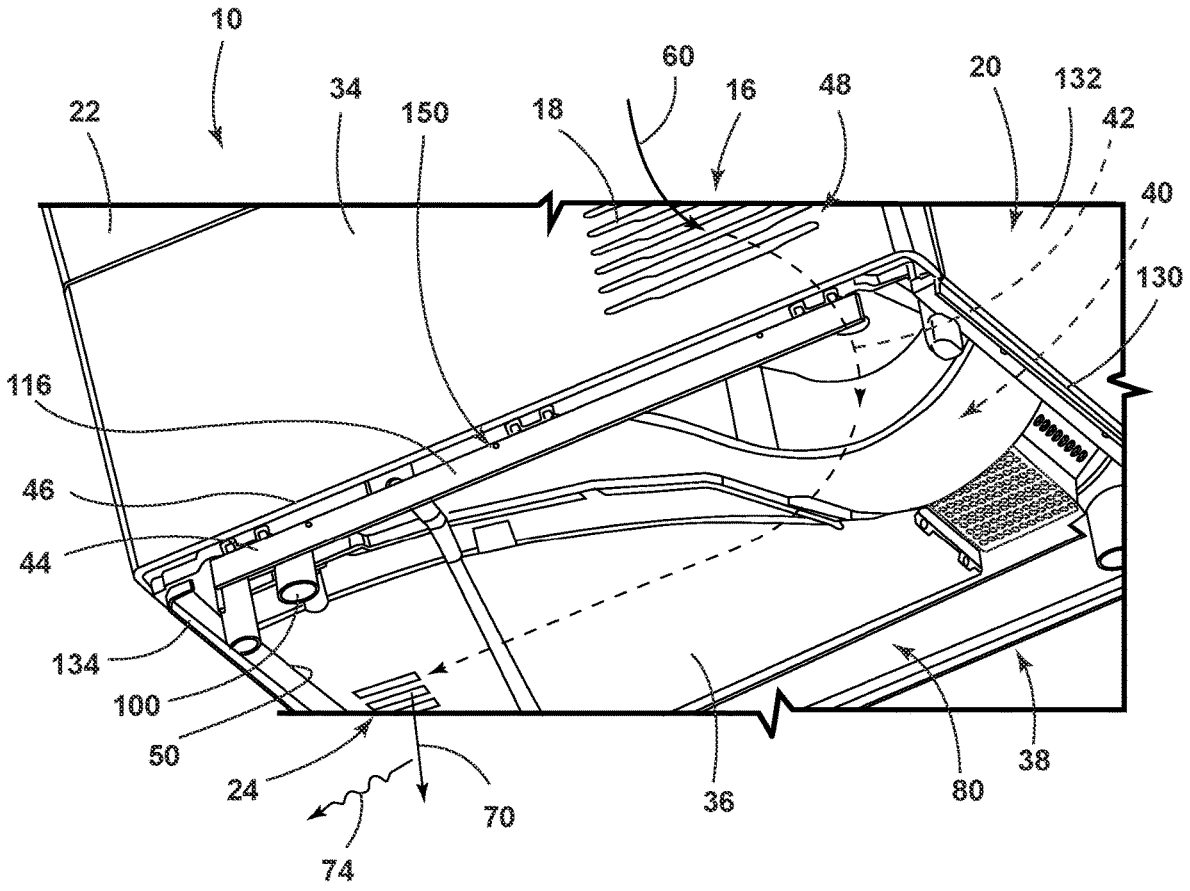
FIG. 5 is a bottom perspective view of the laundry appliance of FIG. 3 showing attachment of the airflow seal to a structure of the laundry appliance.
Figure 6:
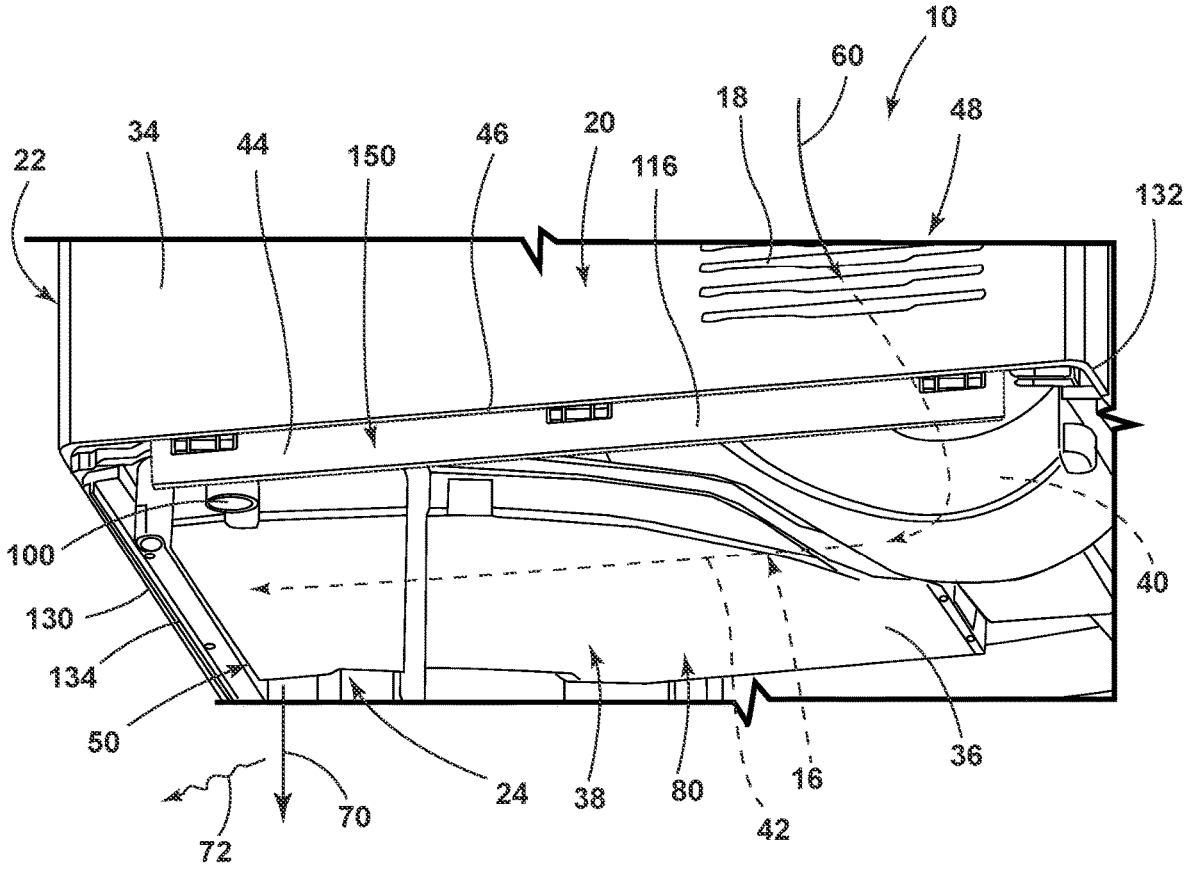
FIG. 6 is a bottom perspective view of an aspect of the laundry appliance showing attachment of the airflow seal to the structure of the cabinet.

As exemplified in FIGS. 3, 5 and 6, the airflow seal 44 can be an elastomeric member that extends downward from either the front panel 34 or a portion of the basement 38 for the appliance 10. In either instance, the airflow seal 44 is positioned parallel with, and adjacent to, the front panel 34 so that the convection barrier 150 is positioned at or near the front edge 46 of the appliance 10. The elastomeric seal can be configured to be longer than the feet 100 that support the cabinet 22 in the basement 38. In this manner, adjustments to the feet 100 of the appliance 10 during installation and use do not affect the engagement of the airflow seal 44 with the floor surface 82. Stated another way, where the feet 100 of the appliance 10 are adjusted to elevate the cabinet 22, the airflow seal 44 can have a height 102 greater than that of the feet 100 such that the airflow seal 44 maintains the engagement with the floor surface 82 after various adjustments are complete. It is also contemplated that the airflow seal 44 can be in the form of a semi-permeable material that extends from the front edge 46 of appliance 10 to the floor surface 82. Where a semi-permeable membrane is utilized, small portions of the exhaust air 70 may permeate through the airflow seal 44. A majority of the exhaust air 70 is directed to the circuitous route 72.

Referring again to FIGS. 3, 5 and 6, the airflow seal 44 having the form of an elastomeric flap 116 can be attached to the underside 80 of the appliance 10 through various clasps, hooks, or other similar mechanical fasteners. The elastomeric flap 116 of the airflow seal 44 can also be attached via screws, and other similar fasteners. Over time, the elastomeric flap 116 may tend to crack, become dry, or lose certain amounts of elasticity. It is contemplated that the fasteners can be disengaged for replacement of the airflow seal 44 over time. It may also be useful to separate the airflow seal 44 from the bottom of the appliance 10 for periodic cleaning of the airflow seal 44.

Figure 7:
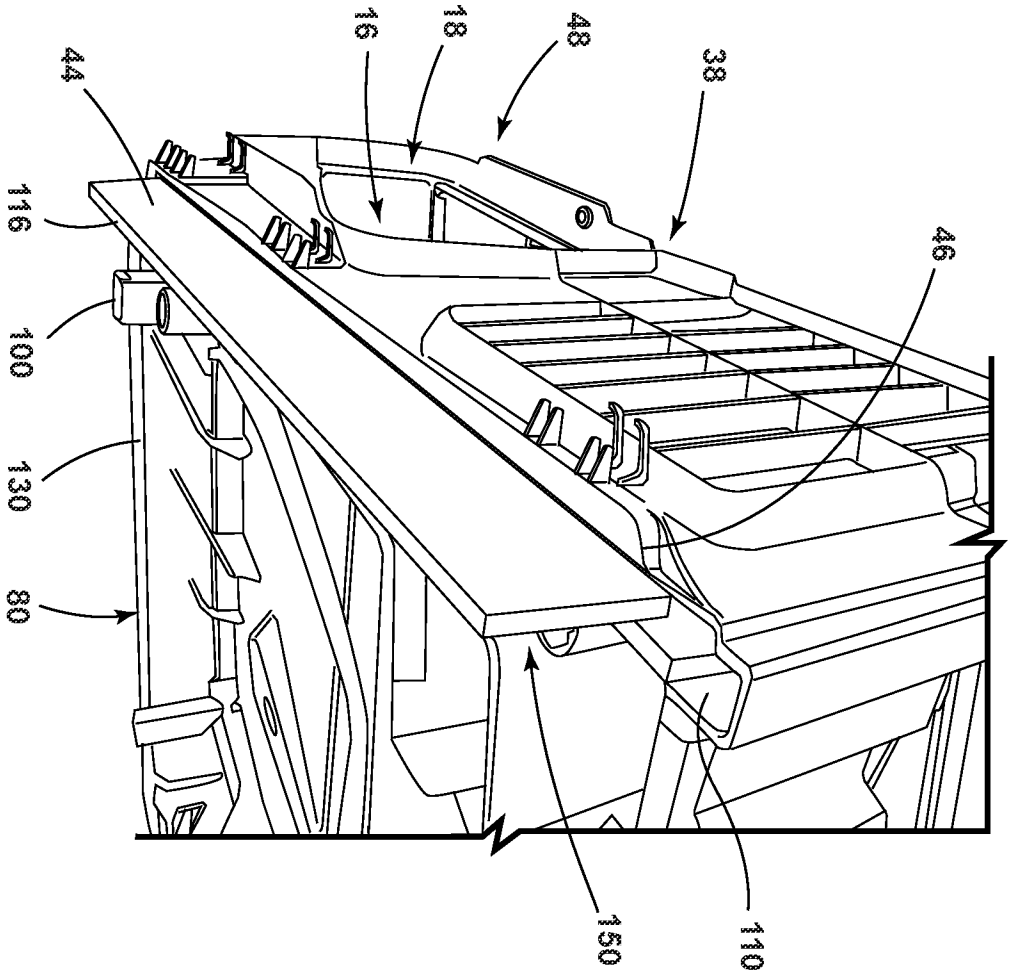
FIG. 7 is a bottom perspective view of an aspect of a basement for a laundry appliance and showing attachment of the airflow seal to the basement for the laundry appliance.

Referring to FIG. 7, it is contemplated that the elastomeric seal can be engaged with a channel 110 defined within the basement 38 for the appliance 10. In this manner, the airflow seal 44 can slidably engage and be fastened within a receiving channel 110 formed within the basement 38. Through this engagement, the airflow seal 44 can be installed, removed, replaced, and otherwise be manipulated for various use and maintenance activities.

Figure 2:
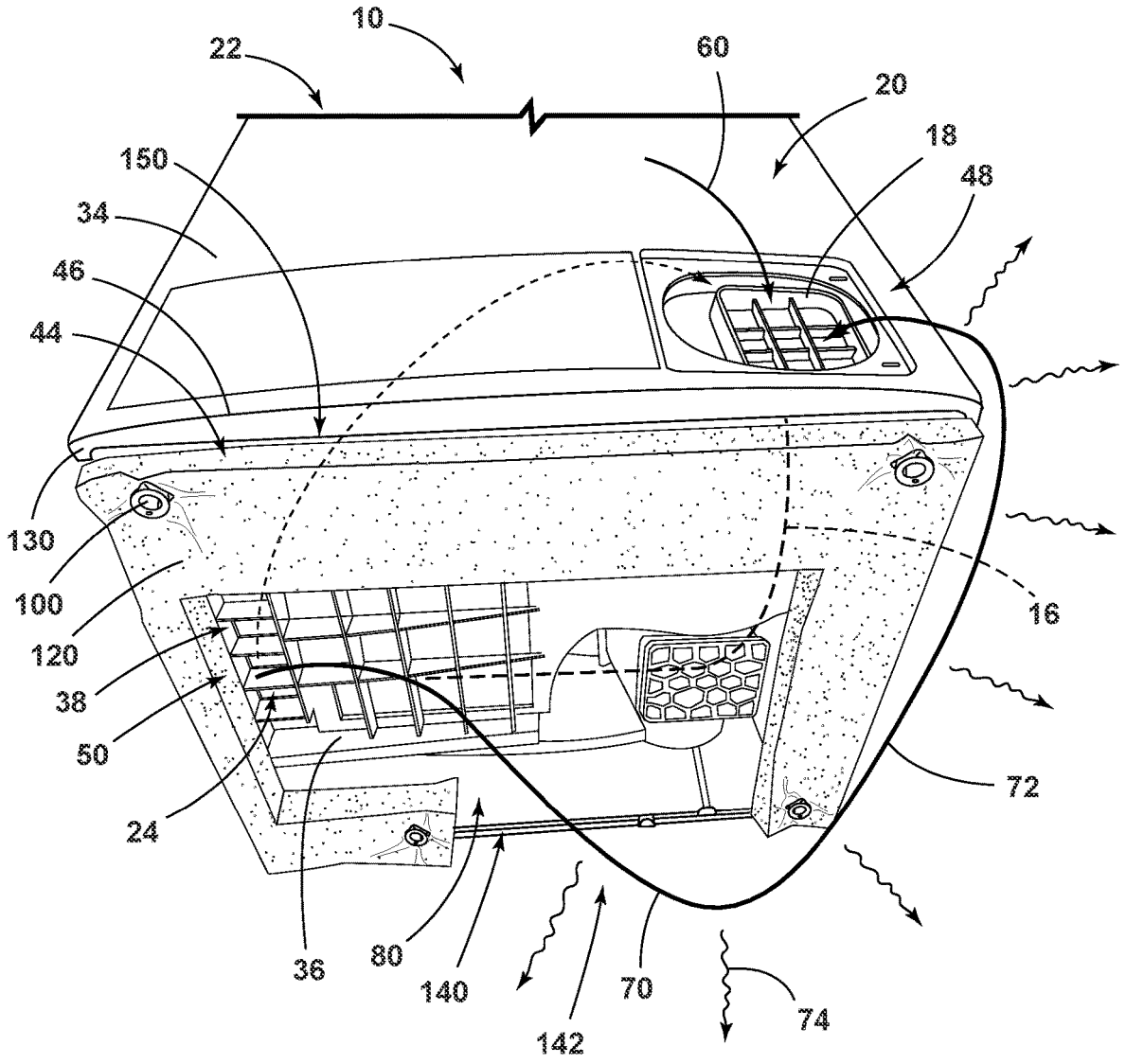
FIG. 2 is a bottom perspective view of an aspect of the airflow seal and showing external airflow streams indicative of appliances including the airflow seal and excluding the airflow seal.
Figure 4:
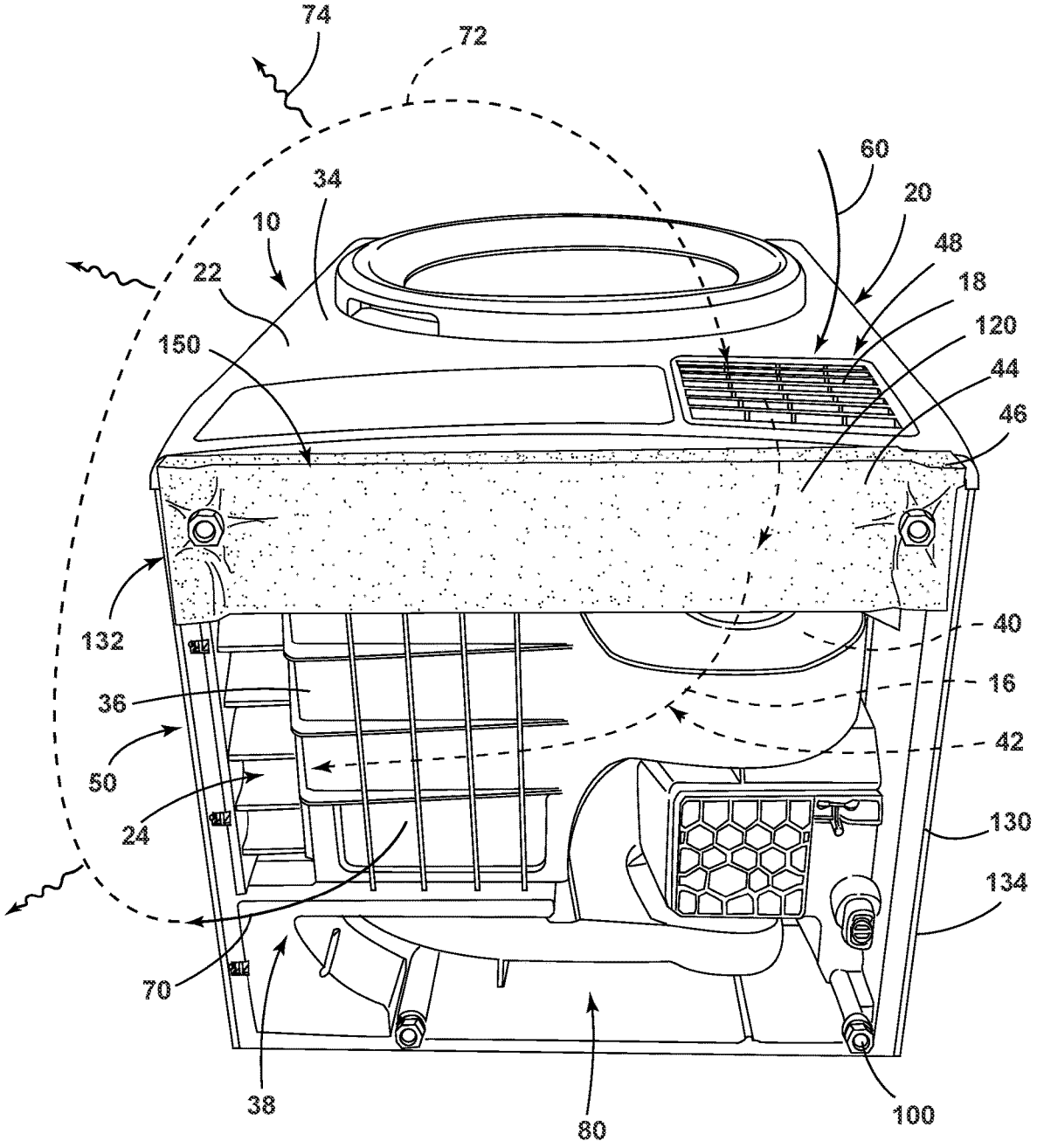
FIG. 4 is a bottom perspective view of a laundry appliance incorporating an aspect of the airflow seal.

Referring now to FIGS. 2 and 4, the airflow seal 44 can be in the form of a block 120 that is attached to a bottom panel 36 of a cabinet 22. As discussed above, this bottom panel 36 can be in the form of a basement 38 of the appliance 10. It is also contemplated that the bottom panel 36 can be in the form of a lower edge 130 of the outer walls 132 of the cabinet 22. These outer walls 132 can include the front panel 34, the side panels 134 and the rear panel of the cabinet 22.

Referring again to FIGS. 2 and 4, the airflow seal 44 that takes the form of a block 120 can extend at least partially along lower edges 130 of the side panels 134 for the cabinet 22. It is also contemplated that the airflow seal 44 can extend around substantially all of the lower edge 130 of the cabinet 22. In such a configuration, the airflow seal 44 can include an opening 140 that defines an airflow outlet 142 that is positioned proximate the outlet 24 for the condensing airflow path 16. Through this configuration, the circuitous route 72 of the exhaust air 70 that may travel from the outlet 24 back to the inlet 18 of the condensing airflow path 16 can be more specifically defined. Accordingly, where the airflow seal 44 extends around a majority of the perimeter of the lower edge 130 for the appliance 10, the airflow seal 44 can define at least a portion of an exhaust airflow outlet 142 for the condensing airflow path 16.

Referring again to FIGS. 1-7, the condensing appliance 10 includes the cabinet 22 with the processing chamber operably disposed therein. A recirculating airflow path, typically in a form of the primary airflow path 12 for moving the process air, is disposed within the cabinet 22 and extends through the processing chamber and a dehumidification area, typically in the form of a heat exchange mechanism. The condensing airflow path 16 directs condensing air 42 from the inlet 18 disposed within a front panel 34 of the cabinet 22, through the heat exchange mechanism, and to the outlet 24 disposed within the bottom panel 36 of the cabinet 22. The airflow seal 44 extends downward from the front edge 46 of the cabinet 22 and to a position below the supporting feet 100 for the cabinet 22. The airflow seal 44 defines the convection barrier 150 that separates the high-pressure region 50 proximate the outlet 24 from the low-pressure area 48 proximate the inlet 18. Through this configuration, the convection barrier 150 prevents or at least slows the natural process of convection between the high-pressure region 50 and the low-pressure region 48. As discussed above, by preventing this direct path between the high-pressure region 50 and the low-pressure region 48, heat 74 is able to be dissipated from the exhaust air 70 leaving the outlet 24.

Referring again to FIGS. 1-7, an airflow system for the condensing appliance 10 includes the primary airflow path 12 that moves process air between the heat exchange mechanism and the processing chamber. Typically, this primary airflow path 12 is a closed-loop system that circulates within the cabinet 22 for the appliance 10. The airflow system for the appliance 10 also includes the condensing airflow path 16 that is an open-loop airflow path extending from the inlet 18, through the heat exchange mechanism, and to the outlet 24.

Referring again to FIGS. 1-7, the airflow system for the condensing appliance 10 includes the outer cabinet 22 having the recirculating or closed-loop primary airflow path 12 contained therein. The condensing airflow path 16 is in thermal communication with the recirculating airflow path at the heat exchange mechanism. The condensing airflow path 16 extends from the inlet 18 located proximate the front panel 34 of the appliance 10 to an outlet 24 located proximate the bottom panel 36 of the appliance 10. The inlet 18 defines the low-pressure region 48 within an area in front of the front panel 34 of the cabinet 22. The outlet 24 defines the high-pressure region 50 from an area beneath the cabinet 22. The convection barrier 150 is positioned along the front edge 46 of the cabinet 22 and is attached to the cabinet 22 along the lower front edge 46. The convection barrier 150 divides the high-pressure region 50 and the low-pressure region 48 and blocks convection therebetween. Accordingly, the exhaust air 70 leaving the outlet 24 is not permitted to extend directly to the inlet 18. Rather, this exhaust air 70 must travel through a circuitous route 72 so that heat 74 can dissipate from the exhaust air 70 before it potentially returns into the inlet 18 and back into the condensing airflow path 16.

According to various aspects of the device, the airflow seal 44 can be incorporated within the basement 38 of the appliance 10 via the supporting feet 100. In such an embodiment, the supporting feet 100 can extend through a portion of the material of the airflow seal 44.

Referring again to FIGS. 1-7, the airflow seal 44 can be in the form of an elastomeric flap 116. In addition, the airflow seal 44 can include an insulation block 120 that can be made up of a fibrous batting or foam-type material. In such an embodiment, the airflow seal 44 can take the form of the block 120 that extends along the front edge 46 of the appliance 10, as well as at least a portion of the side edges of the appliance 10. It is also contemplated that the elastomeric flap 116 of the airflow seal 44 can also extend around at least a portion of the perimeter of the appliance 10 between the lower edge 130 of the appliance 10 and the floor surface 82. These configurations of the airflow seal 44 can be used to direct the exhaust air 70 into a particular circuitous route 72 or exhausting region next to or behind the appliance 10.

According to the various aspects of the device, the airflow seal 44 can be utilized within any one of various laundry appliances 10 that include an open-loop airflow path. The use of the airflow seal 44 can prevent the short circuiting or direct movement of exhaust air 70 from the outlet 24 to the inlet 18. As discussed above, this short circuiting or direct movement of the exhaust air 70 may affect the efficiency of the appliance 10. The use of the airflow seal 44 can prevent this short circuiting and prevent heated exhaust air 70 from entering into the inlet 18 for the appliance 10.

According to another aspect of the present disclosure, a drying appliance includes a cabinet with a processing chamber operably disposed therein. A blower delivers process air through an airflow path. The airflow path includes the processing chamber. A condensing airflow path has an inlet positioned within a front panel of the cabinet and an outlet positioned within a bottom panel of the cabinet. A condensing blower moves condensing air from the inlet to the outlet. An airflow seal extends downward from a front edge of the cabinet. The airflow seal separates a low-pressure region proximate the inlet from a high-pressure region proximate the outlet to block convection between the outlet and the inlet.

According to another aspect, the airflow seal is configured to engage a floor surface below the cabinet.

According to yet another aspect, the airflow seal extends along an entirety of the front edge of the front panel.

According to another aspect of the present disclosure, the airflow seal is an elastomeric flap.

According to another aspect, the airflow seal is a block that is attached to a bottom panel of the cabinet.

According to yet another aspect, the airflow seal extends at least partially along lower side edges of the cabinet.

According to another aspect of the present disclosure, the airflow seal extends around a lower edge of the cabinet and defines an airflow outlet for directing condensing air from the outlet to an area proximate a rear panel of the cabinet.

According to another aspect, a condensing dryer includes a cabinet with a processing chamber operably disposed therein. A recirculating airflow path is disposed within the cabinet and extends through the processing chamber and a dehumidification area. A condensing airflow path directs condensing air from an inlet disposed within a front panel of the cabinet, through the dehumidification area and to an outlet disposed within a bottom panel of the cabinet. An airflow seal extends downward from a front edge of the cabinet and to a position below supporting feet of the cabinet. The airflow seal defines a convection barrier that separates a high-pressure region proximate the outlet from a low-pressure region proximate the inlet.

According to yet another aspect, the airflow seal is configured to engage a floor surface below the cabinet.

According to another aspect of the present disclosure, the airflow seal extends along an entirety of the front edge of the front panel.

According to another aspect, the airflow seal is an elastomeric flap.

According to yet another aspect, the airflow seal is a block that is attached to a bottom wall of the cabinet and extends at least partially along lower side edges of the cabinet.

According to another aspect, the airflow seal extends around a lower edge of the cabinet and defines an airflow outlet for directing condensing air from the outlet to an area proximate a rear panel of the cabinet.

According to yet another aspect, an airflow system for a laundry appliance includes an outer cabinet having a recirculating airflow path contained therein. A condensing airflow path is in thermal communication with the recirculating airflow path and extends from an inlet proximate a front panel of the outer cabinet to an outlet proximate a bottom panel of the outer cabinet. The inlet defines a low-pressure region within an area in front of the front panel of the outer cabinet and the outlet defines a high-pressure region within an area beneath the outer cabinet. A convection barrier is attached to the cabinet along a lower front edge. The convection barrier blocks convection between the low-pressure region and the high-pressure region.

According to another aspect of the present disclosure, the inlet is positioned within the front panel of the cabinet and the outlet is positioned within the bottom panel.

According to yet another aspect, the convection barrier is an airflow seal is configured to engage a floor surface below the cabinet.

According to another aspect of the present disclosure, the airflow seal extends along an entirety of the front edge of the front panel.

According to another aspect, the airflow seal is an elastomeric flap.

According to yet another aspect, the airflow seal is a block that is attached to a bottom wall of the cabinet.

According to another aspect of the present disclosure, the airflow seal extends around a lower edge of the cabinet and defines an airflow outlet for directing condensing air from the outlet to an area proximate a rear panel of the cabinet.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width 90 of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An airflow system for an appliance, the airflow system comprising:

a recirculating airflow path that is disposed within a cabinet and that extends through a heat exchange area;

an open-loop airflow path that directs secondary air from an inlet disposed within an exterior panel of the cabinet, through the heat exchange area, and to an outlet disposed within a bottom wall of the cabinet; and an airflow seal extending downward from a lower edge of the cabinet, proximate the inlet, and to a position below supporting feet of the cabinet, the airflow seal defining a convection barrier that separates a high-pressure region proximate the outlet from a low-pressure region proximate the inlet.

2. The airflow system of claim 1, wherein the airflow seal extends around the lower edge of the cabinet and defines an airflow outlet for directing a flow of the secondary air from the outlet to an area proximate a rear panel of the cabinet.

3. The airflow system of claim 1, wherein the airflow seal is configured to engage a floor surface below the cabinet.

4. The airflow system of claim 1, wherein the airflow seal extends along the lower edge of at least a front panel and one side panel of the cabinet.

5. The airflow system of claim 1, wherein the airflow seal is an elastomeric flap.

6. The airflow system of claim 1, wherein the airflow seal is a block that is attached to the bottom wall of the cabinet.

7. The airflow system of claim 1, wherein the inlet is positioned within a front panel of the cabinet.

8. An appliance comprising:

a blower that delivers process air through a primary airflow path that is disposed within a cabinet;

an open-loop airflow path having an inlet positioned within an exterior panel of the cabinet and an outlet positioned within a bottom wall of the cabinet, wherein a secondary blower moves a secondary flow of air from the inlet, through the open-loop airflow path and to the outlet, the open-loop airflow path in thermal communication with the primary airflow path; and an airflow seal extending downward from a lower edge of the exterior panel, below the inlet, the airflow seal separating a low-pressure region proximate the inlet from a high-pressure region proximate the outlet to block convection between the outlet and the inlet.

9. The appliance of claim 8, wherein the open-loop airflow path is thermally coupled with the primary airflow path within a heat exchanger.

10. The appliance of claim 8, wherein the airflow seal is configured to engage a floor surface below the cabinet.

11. The appliance of claim 8, wherein the exterior panel includes at least one of a front panel and a side panel of the cabinet, and wherein the airflow seal extends along an entirety of the lower edge of the exterior panel.

12. The appliance of claim 8, wherein the airflow seal is an elastomeric flap.

13. The appliance of claim 8, wherein the airflow seal is a block that is attached to the bottom wall of the cabinet.

14. The appliance of claim 8, wherein the airflow seal extends around the lower edge and defines an airflow outlet for directing the secondary flow of air from the outlet to an area proximate a rear panel of the cabinet.

15. The appliance of claim 8, wherein the inlet is positioned within a front panel of the cabinet.

16. An airflow system for an appliance, the airflow system comprising:

an outer cabinet having a recirculating airflow path contained therein;

an open-loop airflow path in thermal communication with the recirculating airflow path and extending from an inlet proximate an exterior panel of the outer cabinet to an outlet disposed proximate a bottom wall of the outer cabinet, wherein the inlet defines a low-pressure region within an area proximate the exterior panel of the outer cabinet, and wherein the outlet defines a high-pressure region within an area beneath the bottom wall of the outer cabinet; and a convection barrier that is attached to the outer cabinet along a portion of a lower edge proximate the inlet, the convection barrier blocking convection between the low-pressure region and the high-pressure region.

17. The airflow system of claim 16, wherein the inlet is positioned within a front panel of the outer cabinet.

18. The airflow system of claim 16, wherein the outlet is disposed within the bottom wall of the outer cabinet.

19. The airflow system of claim 16, wherein the convection barrier extends along the lower edge below at least a front panel and one side panel of the outer cabinet.

20. The airflow system of claim 16, wherein the convection barrier extends around the lower edge and defines an airflow outlet for directing a flow of air from the outlet to an area proximate a rear panel of the outer cabinet.

* * * * *